US008250691B2

(12) United States Patent
Pillsticker

(10) Patent No.: US 8,250,691 B2
(45) Date of Patent: Aug. 28, 2012

(54) TUNNEL WASHER, AND WASHING METHOD

(75) Inventor: Dirk Pillsticker, Gronau (DE)

(73) Assignee: Jensen GmbH, Harsum (DK)

( * ) Notice: Subject to any disclaimer, the term of this patent is extended or adjusted under 35 U.S.C. 154(b) by 906 days.

(21) Appl. No.: 12/298,383

(22) PCT Filed: Apr. 26, 2007

(86) PCT No.: PCT/EP2007/003706

§ 371 (c)(1),
(2), (4) Date: Jan. 6, 2009

(87) PCT Pub. No.: WO2007/124918

PCT Pub. Date: Nov. 8, 2007

(65) Prior Publication Data

US 2009/0165217 A1 Jul. 2, 2009

(30) Foreign Application Priority Data

Apr. 26, 2006 (DE) ..... 10 2006 019 458

(51) Int. Cl.
*D06F 31/00* (2006.01)

(52) U.S. Cl. ..... 8/159; 68/27; 68/143

(58) Field of Classification Search ..... 68/27, 58, 68/143, 145, 158; 8/158, 159
See application file for complete search history.

(56) References Cited

U.S. PATENT DOCUMENTS

| | | | | | |
|---|---|---|---|---|---|
| 2,337,137 | A | * | 12/1943 | Thompson et al. | 422/645 |
| 3,878,699 | A | * | 4/1975 | Steinort | 68/145 |
| 4,034,583 | A | | 7/1977 | Miessler | |
| 4,109,493 | A | * | 8/1978 | Hugenbruch | 68/27 |
| 4,951,458 | A | | 8/1990 | Steinort | |
| 4,984,438 | A | * | 1/1991 | Batty | 68/27 |
| 5,211,039 | A | * | 5/1993 | Pellerin | 68/27 |
| 5,307,652 | A | * | 5/1994 | Hagiwara et al. | 68/27 |
| 5,392,480 | A | * | 2/1995 | Ishihara et al. | 8/159 |
| 6,076,379 | A | * | 6/2000 | Grandpierre | 68/27 |

FOREIGN PATENT DOCUMENTS

| | | |
|---|---|---|
| DE | 198 12 386 A1 | 9/1999 |
| DE | 199 41 073 A1 | 9/2003 |
| EP | 0 324 655 A1 | 7/1989 |
| EP | 0 364 763 A1 | 4/1990 |

OTHER PUBLICATIONS

International Search Report, mailed Sep. 18, 2007.

* cited by examiner

*Primary Examiner* — Joseph L Perrin
(74) *Attorney, Agent, or Firm* — Pearne & Gordon LLP

(57) ABSTRACT

In a continuous washing machine, a drum (2) comprising, in longitudinal direction (4), washing chambers (12), which are adjacent to and separate from each other and through which the laundry items (22) to be washed can be conveyed in longitudinal direction of the drum (2), can be driven so as to rotate about its longitudinal axis (4) in two opposing directions of rotation (B, C), whereby a first direction of rotation (C) corresponds to a washing mode and the second direction of rotation (B) corresponds to a conveying mode. Arranged inside the washing chambers (12) are entrainment devices (14) extending in outward direction toward the interior wall of the drum (2) and being non-rotationally connected to the drum (2), said entrainment devices carrying along the laundry items (22) and the treatment fluid (20) during the rotation of the drum (2) in washing mode. The washing chambers (12) that are separate from each other are formed by a screw (6), said screw being connected along its outside edge (8) to the drum (2).

22 Claims, 3 Drawing Sheets

TUNNEL WASHER, AND WASHING METHOD

Figure 1:
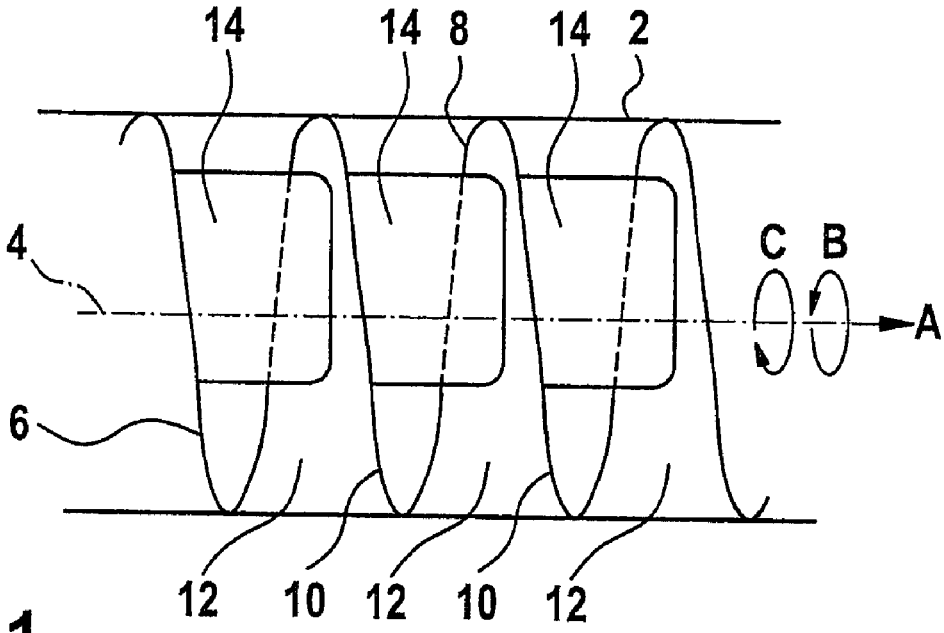

The invention relates to a continuous washing machine in accordance with the preamble of Claim 1, as well as to a washing process used by such a continuous washing machine in accordance with the preamble of Claims 16 and 17, respectively.

Continuous washing machines operate based on a pivoting or rotating washing principle. The laundry transport is accomplished along the generated surface of the drum or through the center of the drum.

For example, a continuous washing machine in accordance with the preamble of Patent Claim 1 has been known from document DE 199 41 073 A1. In this case, the washing regions located next to each other in longitudinal direction of the drum are configured as washing chambers defined by discoidal dividing walls, said dividing walls being arranged in the drum perpendicular to the longitudinal axis of the drum and their exterior edges being welded to the drum. In order to pass laundry items from one washing chamber into the adjacent washing chamber, central circular openings are provided in the dividing walls, each of said openings being provided upstream with a blade-like structure that also comprises a metal dividing baffle.

Considering this prior art, when the drum is in washing mode, the laundry items are lifted by means of a metal entrainment baffle or dividing baffle and are subsequently allowed to drop from above into the treatment fluid during each rotation of the drum. When the direction of rotation of the drum is reversed for the purpose of conveying the laundry items into the next washing chamber, the laundry and at least a part of the treatment fluid are moved by means of the blade-like structure to the opening in the dividing wall and from there—viewed in conveying direction—to the adjacent washing chamber.

One disadvantage of this known continuous washing machine consists in that the material of the drum having, in particular, a length of several meters is subject to high mechanical loads, whereby the straight, planar dividing walls existing in this case do not result in any increase of the strength of the drum. Furthermore, the high mechanical load requires a comparably high strength of the material of the drum, thus leading to increased manufacturing costs, on the one hand, and to increased energy use for driving the drum, on the other hand.

Another disadvantage of the known continuous washing machine consists in that, while the laundry items are being passed from one chamber to the adjacent chamber through the opening or the transport channel in the corresponding dividing wall, the risk of an obstruction of the opening occurs. This risk of obstruction is considerable if it is taken into consideration that the drum, as a rule, comprises a plurality of successive washing chambers in longitudinal direction of the drum and that the laundry items must therefore be passed through a plurality of openings during a single pass through the plant.

Considering another design of a continuous washing machine, e.g., in accordance with document DE 364 763, an Archimedean screw or worm is arranged in the drum that can be selectively rotated in one or the other direction, said screw or worm being non-rotationally connected to the drum and being connected in a fluid-tight manner to the inside of the drum along said drum's exterior edge. The setup of this arrangement basically corresponds to that of a screw-tube conveyor. Respectively one washing chamber is defined between two adjacent cants of a screw, thus corresponding to a washing chamber of the aforementioned prior art. In order to convey the laundry items from one washing chamber to the other washing chamber, the drum, along with the screw, is rotated by 360°, whereby, consistent with the known mode of operation of a screw-tube conveyor, the items of laundry lying in the treatment fluid, along with the treatment fluid, are advanced in conveying direction by a distance corresponding to the width of one washing chamber. During the washing cycle, the drum, including the screw, is intermittently moved in one and in the other direction, i.e., back and forth, and the required washing mechanics are thus generated.

By building-in the screw or worm, the drum is imparted with particular structural rigidity, so that minimal material thicknesses are sufficient to achieve the necessary strength.

The object of the invention is to provide a continuous washing machine that displays particular mechanical stability, which largely avoids obstructions while the laundry items are conveyed and that, nevertheless, is capable of washing in a rotating manner. Also, a washing process suitable for this washing machine is to be provided.

In accordance with the invention, this object is essentially achieved by a washing machine displaying the features in accordance with Claim 1, as well as with a washing process in accordance with Claims 16 and 17.

Consequently, in accordance with the invention, indeed, the basic design of a screw-tube conveyor or an Archimedean screw is provided; however, if the plant operates in washing mode, a continued transport of the laundry items in axial direction by the entrainment device is prevented, so that, during a given washing cycle, washing always occurs in the same washing region, even though the drum, including the screw, rotates continuously.

The continuous washing machine in accordance with the invention displays the following advantages:

On the one hand, the continuous washing machine in accordance with the invention is characterized by great stability in that it is basically designed consistent with the principle of a screw-tube conveyor, whereby the worm or screw located in the drum and connected to the drum provides mechanical stability for the overall design, so that, with the use of a relatively light-weight design, it is still possible to achieve the necessary mechanical stability and that relatively low driving energy is sufficient during operation.

Also, with the use of the inventive continuous washing machine, it is possible to virtually exclude the risk of obstruction while the laundry items are being transported in conveying direction from chamber to chamber, in that the laundry items need no longer be passed through openings in the chamber walls (the transport channel) but, rather, are conveyed over a blade along the path of the worm or screw.

In washing mode, the laundry items and the bath are lifted by the blade-like entrainment device and again dropped from the top into the same washing chamber. During this process that is repeated many times in the course of a washing cycle the fabric of the laundry items is perfused by the treatment fluid because said fluid moves ahead of this fabric and the laundry subsequently drops into the treatment fluid. The fibers of the fabric are stretched and then compressed again, thus promoting perfusion of the fabric.

In washing mode, the continuous washing machine in accordance with the invention may advantageously be selectively operated either in a rotating or also in a back-and-forth pivoting manner.

In conveying mode of the continuous washing machine in accordance with the invention the laundry is transported by means of the screw in conveying direction, on the one hand, and first lifted by means of the entrainment device and then dropped again by the entrainment device during further rotation of the drum, on the other hand. Basically, the treatment fluid may take the same path.

Additional advantageous features of the invention result from the additional subordinate claims in conjunction with the description hereinafter.

Figure 2:
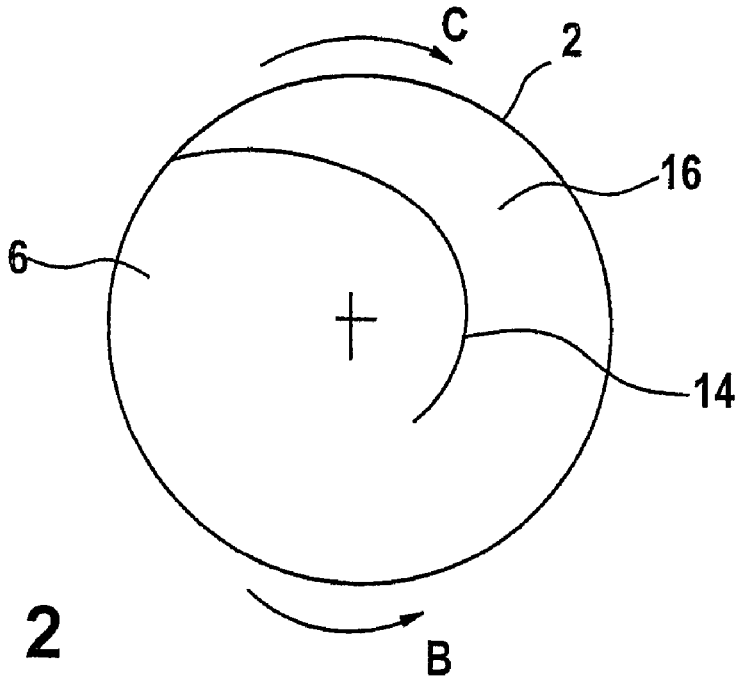
Figure 5:
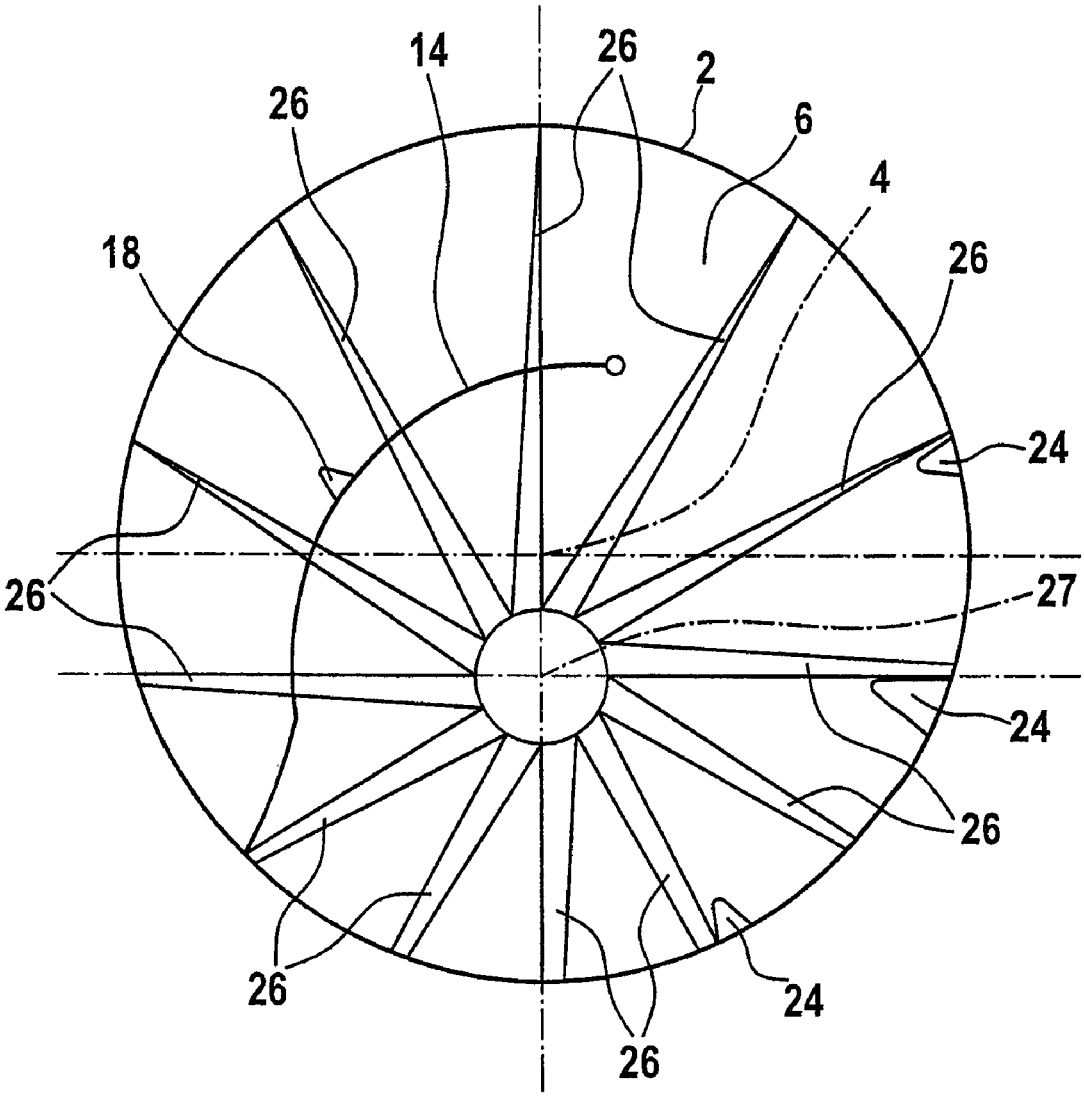

Exemplary embodiments are shown in the drawings and will be described in detail hereinafter. The drawings show in:

FIG. 1 a schematic partial side elevation of a continuous washing machine in accordance with the invention;

FIG. 2 a sectional view of the continuous washing machine in accordance with FIG. 1, perpendicular to the illustration of FIG. 1;

FIGS. 3*a* through 3*e* schematic sectional views of the continuous washing machine in accordance with FIG. 1, in different angular positions in washing mode;

FIGS. 4*a* through 4*e* schematic sectional views of the continuous washing machine in accordance with FIG. 1, in different angular positions in conveying mode;

FIG. 5 another schematic sectional view of the continuous washing machine in accordance with FIG. 1, this showing the ribs on the metal entrainment baffle, on the screw as well as on the inside of the drum.

To the extent that, above and hereinafter, reference is being made to "washing mode," "washing region," "washing chamber," etc., these may be presumed to be treatments that usually occur in a washing machine of the type concerned here, namely, in particular, also rinsing and, optionally, also conditioning, so that, in particular, a "rinsing mode," "rinsing region," "rinsing chamber," etc. are to be included.

First, reference is made to FIGS. 1 and 2. A continuous washing machine that is not shown in detail comprises a cylindrical drum 2 or an interior drum 2 that can be rotated about its longitudinal axis 4 by means of driving means that are known per se and are thus not specifically illustrated, i.e., in one of the two possible driving directions. Located inside the drum 2 is a worm 6 or a screw 6 which, e.g., may consist of canted sheet metal and whose exterior helical exterior edge 8 is joined, in particular welded, to the interior wall of the drum 2. In so doing, the screw 6 has helical cants or reinforcement ribs that are not specifically illustrated here and that extend in radial direction. The arrangement of the rotatably supported drum 2, including the screw 6 that is located therein and non-rotationally connected to the drum 2 corresponds to the arrangement of a screw-tube conveyor.

A feeding hopper, for example, is used for loading the laundry items to be treated into the drum 2 in a not specifically illustrated manner from the left, referring to the illustration in accordance with FIG. 1; and, in a likewise un-illustrated manner, the treated laundry items are moved out of the continuous washing machine to the right, referring to the illustration in accordance with FIG. 1, for example, by means of an output slide; and, subsequently, said laundry items are passed on to a water-extracting device, for example, namely a water-extracting press, for example. In conveying mode, the laundry items are transported through the drum 2 in the general conveying direction A by rotation of the drum 2, including the screw 6, in the direction of rotation B in a counterclockwise direction.

A space disposed to act as a washing chamber 12 is respectively defined by two opposing screw sections 10 of the screw 6. Arranged in each washing chamber 12 is an entrainment device 14 being configured as a metal entrainment baffle 14 that, among other things, is disposed to carry along the laundry items when the drum 2 and the screw 6 are being rotated in washing mode, i.e., lift said laundry items, etc; see further below. Each metal entrainment baffle 14 is laterally joined, in particular welded, to the adjacent screw sections 10 in a fluid-tight manner and extends from an approximately central position between the longitudinal axis 4 and the interior wall of the drum 2 in outward direction toward the interior wall of the drum 2, to which said baffle is also joined, in particular welded, in a fluid-tight manner. Each metal entrainment baffle 14 is curved spiral-like about the longitudinal axis 4, as is particularly obvious from FIG. 2, whereby the radius of curvature relative to the longitudinal axis 4 increases from the inside toward the outside. All metal entrainment baffles 14 are aligned inside the drum 2, preferably in the same direction of orientation.

When the drum 2, including the screw 6, is now rotated in the direction of rotation C, the laundry items, along with the treatment fluid, arrive—in the course of the rotation—in the space 16 having approximately the shape of a triangle or tapering in a crescent-like manner between the entrainment baffle 14 and the interior wall of the drum 2 opposite said baffle and are transported upward into this space 16 during continued rotation until, with further rotation, this space 16 is emptied, whereby, during a first phase, first and foremost part of the treatment fluid runs over or out and collects on the bottom of the washing region 12 and, during a second phase, the laundry items, along with the remaining treatment fluid, drop into the treatment fluid on the bottom.

Here, it is essential that, during the rotation of the drum 2 in washing mode in the direction of rotation C, the entrainment baffles 14 prevent a transport of the laundry items (and the treatment fluid) along the longitudinal axis 4 as would be the case in a screw-tube conveyer. Rather, the laundry items, along with the treatment fluid, are held in one and the same washing chamber 12 during the entire washing cycle while the drum continuously rotates in the direction of rotation C.

When, upon completion of a washing cycle, the direction of rotation of the drum 2 is reversed and the drum 2, together with the screw 6, is driven in the direction of rotation B, the laundry, optionally together with the treatment fluid, is conveyed in longitudinal direction 4 of the drum from one washing chamber 12 to the adjacent washing chamber 12, as corresponds to the usual operation of a screw-tube conveyor. However, the laundry items are increasingly lifted by means of the entrainment baffle 14 during the rotation and finally drop over the free edge of the entrainment baffle 14 downward to the bottom of that washing chamber 12 which is adjacent to the previous, original washing chamber 12.

Now, reference is being made to FIGS. 3*a* through 3*e* as well as to 4*a* through 4*e* that show various phases of the washing mode or conveying mode, respectively in 90° steps of rotation of the drum 2:

In washing mode in accordance with FIGS. 3*a* through 3*e*, the drum 2 is continuously driven in the direction of rotation C. Assumed in this case is the situation in accordance with FIG. 3*a*. The treatment fluid 20 has collected in the chamber 12 on the bottom of the drum 2, the laundry items 22 are lying or floating in the treatment fluid 20. The metal entrainment baffle 14 is essentially located above the treatment fluid 20 and the laundry items 22, respectively.

Figure 3A:
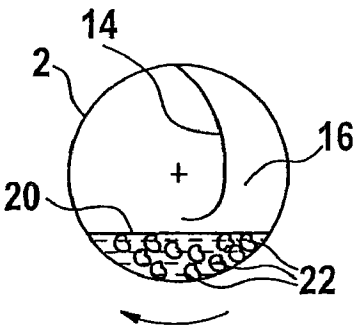
Figure 3B:
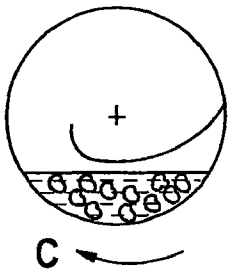

With a further rotation of the drum 2 into the position in accordance with FIG. 3*b*, the treatment fluid 20, along with the laundry items 22, arrives in the space 16 between the metal entrainment baffle 14 and the opposing drum wall, i.e., in other words, the metal entrainment baffle 14 slides itself over the treatment fluid 20, along with the laundry items 22.

Figure 3C:
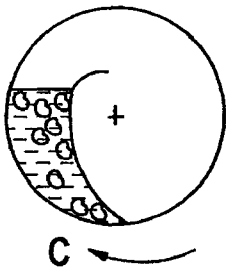

With a further rotation of the drum 2 into the position in accordance with FIG. 3*c*, the treatment fluid 20 and the laundry items 22 have been completely received by the upward-moving space 16 and are moved together in upward direction.

Figure 3D:
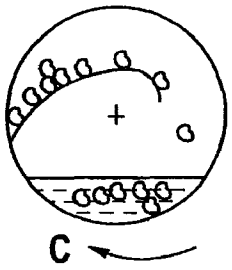

With a further rotation of the drum 2 into the position in accordance with FIG. 3*d*, a major part of the treatment fluid 20 has drained over the interior free edge of the metal entrainment baffle 14 out of the space 16 and flowed back down onto the bottom of the washing region 12. The laundry items 22 gradually drop into the treatment fluid 20 on the bottom, i.e., together with the remainder of the treatment fluid 20 still present in the space 16.

Figure 3E:
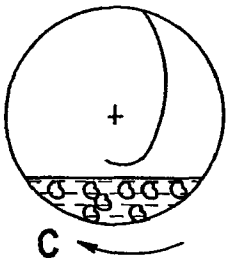

With a further rotation of the drum 2 into the position in accordance with FIG. 3*e*, said position corresponding to the position 3*a*, the space 16 has now completely emptied and the above-described process is repeated until a washing cycle is completed and thus, subsequently, the laundry items 22, along with the washing fluid 20, are to be moved in conveying direction A (see FIG. 1) into the adjacent washing chamber 12, i.e., the continuous washing machine is to be moved into conveying mode.

In the conveying mode in accordance with FIGS. 4*a* through 4*e*, the drum 2 is rotated a single time by 360° in the direction of rotation B. The starting point in FIG. 4*a* may be, for example, the angular position of the drum 2 that corresponds to the position of FIG. 3*a* or 3*e*. In this position, the treatment fluid 20 has collected in the chamber 12 on the bottom of the drum 2, the laundry items 22 are lying or floating in the treatment fluid 20, and the metal entrainment baffle 14 is essentially located above the treatment fluid 20 and the laundry items 22, respectively.

With a rotation of the drum 2 in the direction of rotation B into a position in accordance with FIG. 4*b*, the metal entrainment baffle 14 pivots in the selected direction of rotation and subsequently said baffle's radially outward end pivots downward until it comes into contact with the treatment fluid 20 and the laundry items 22 therein and increasingly lifts said laundry items; see FIG. 4*c*.

Figure 4A:
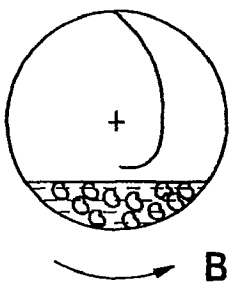
Figure 4B:
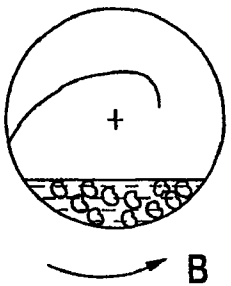
Figure 4C:
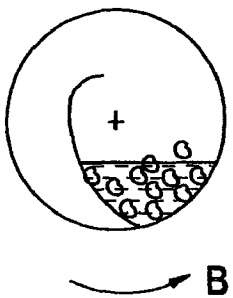
Figure 4D:
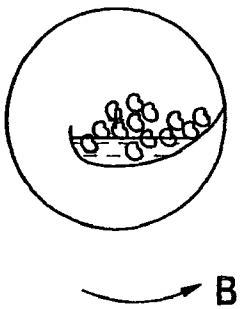

Considering the angular position in accordance with FIG. 4*d*, the laundry items 22 and the treatment fluid 20 have been lifted by the metal entrainment baffle 14 and, with increasing rotation of the drum 2, the treatment fluid 20 drains, and—due to gravitation—the laundry items 22 slide off the metal entrainment baffle 14 into the adjacent washing chamber.

Figure 4E:
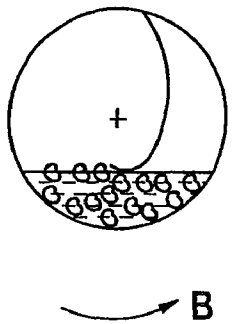

With a further rotation of the drum 2 into the position in accordance with FIG. 4*e* that corresponds to the angular position in accordance with FIG. 4*a*, the laundry items 22 and the treatment fluid 20 have been thrown off by the entrainment baffle 14 in the region of the original washing chamber 12 in the conveying direction A in the adjacent washing chamber.

A conveying cycle is thus completed; the laundry items 22, along with the associate treatment fluid 20, have been conveyed in conveying direction A from one washing chamber 12 into the adjacent washing chamber 12, and a new washing cycle may start.

In addition to the above-described washing mode, which has been described with reference to FIGS. 3*a* through 3*e* and in which the drum 2 is continuously rotated in the direction of the arrow C, an alternative pivoting washing mode as described in the case of the aforementioned prior art is possible, in which case the drum is consequently pivoted back and forth in washing mode, whereby the with pivot angle in washing mode may be approximately 180°, preferably 180°+/−45°, also preferably 180°+/−30°, in particular 180°+/−15°; particularly preferred is an angle of 180°+/−5°.

It should be pointed out that, depending on the process, it is also possible to drain the free treatment fluid 20 over a region of the generated surface of the drum, which is provided with holes, through a dual drum, and that the laundry items 22 are then transported "dry," i.e., without treatment fluid 20, into the next washing chamber or washing region. The continuous washing machine in accordance with the invention thus also permits a transport of the laundry items 22, without treatment fluid, through the drum 2.

Furthermore, it should be pointed out that it may optionally be practical, in particular in a rinsing zone, to provide the screw 6 with holes so that a counter-current may be passed through the screw 6, in particular to permit counter-current rinsing.

It is also understood that the set-up of the plant shown by the figures may also have a mirror-image configuration.

From FIG. 5 it is clear how the design and the operation of the plant may be further optimized by providing diverse ribs. It is understood that the illustration of the number of ribs to be provided and their exact location in FIG. 5 is strictly exemplary and that modifications are possible.

Referring specifically to FIG. 5, one or more, in the case of the exemplary embodiment, one rib 18 (per washing chamber 12) is provided on the metal entrainment baffle 14, said rib extending essentially in longitudinal direction 4 of the drum 2; one or more, in the case of the exemplary embodiment, three ribs 24 (per washing chamber 12) are provided on the interior wall of the drum 2, said ribs also extending essentially in longitudinal direction 4 of the drum; and a plurality of cants 26 of the screw 6 extending radially outward in an approximately star-like manner are provided.

The at least one rib 18 on the metal entrainment baffle 14 is located in the region of the space 16 (see FIG. 3*a*) in order to permit the laundry items 22 to slide more gradually off the metal entrainment baffle 14 or to be pulled apart more, as a result of which, during the washing process, an increased degree of stretching and compressing of the laundry is ensured, thus further increasing the washing quality. The rib 18 may be placed on the entrainment baffle 14, e.g., welded thereto or canted into the metal entrainment baffle 14.

The preferably several ribs 24 on the interior wall of the drum 2 are provided, in particular, for the purpose of generating even more washing mechanics, in particular also in the case of pivoting washing, i.e., in the case, in which the drum 2 of the continuous washing machine performs a back-and-forth pivoting motion in washing mode. The ribs 24 may be welded, for example to the interior wall of the drum 2.

The radially outward extending screw cants 26 on the screw 6 act to stiffen and stabilize the design, on the one hand, and to further intensify the washing mechanics, on the other hand. Alternatively, it is also possible to provide reinforcement ribs which are set on the screw 6, for example, are welded thereto.

Furthermore, FIG. 5 shows that the Archimedean screw 6, considering its structural axis 27, is arranged eccentric relative to the axis of rotation 4 of the washing drum 2.

List of reference signs

2 Drum, interior drum
4 Longitudinal axis, longitudinal direction
6 Worm, screw
8 Exterior edge
10 Screw sections
12 Washing chamber
14 Metal entrainment baffle, entrainment device
16 Space
18 Rib
20 Treatment fluid
22 Laundry items
24 Ribs
26 Screw cants
27 Structural axis A Conveying direction
B Direction of rotation, conveying
C Direction of rotation, washing

The invention claimed is:

1. Continuous washing machine with a drum (2) comprising, in longitudinal direction (4), washing chambers (12), which are arranged adjacent to and separate from each other and through which laundry items (22) to be washed can be conveyed in longitudinal direction of the drum (2), whereby the washing chambers (12) which are separate from each other are configured to represent an Archimedean screw (6) which is connected, along its exterior edge (8) to the drum (2), and that the drum (2) can be driven so as to rotate about its longitudinal axis (4) in two opposing directions of rotation (B, C), whereby a first direction of rotation (C) corresponds to a washing mode and the second direction of rotation (B) corresponds to a conveying mode, whereby, also a washing mode by back-and-forth pivoting of the drum (2) about a pivot angle of 180°+/−45° is possible, namely about a pivot angle within the range of 225° to 135°, when in washing mode, and whereby an entrainment device (14) extending in outward direction toward the interior wall of the drum (2) and being non-rotationally connected to the drum (2) is arranged in at least one of the washing chambers (12), said entrainment device carrying along the laundry items (22) during the rotation of the drum (2) in washing mode, wherein the entrainment device (14) is laterally connected to the screw (6) and is arranged in the washing chamber in such a manner that, in washing mode, the entrainment device (14) prevents a transport of the laundry—against the conveying direction (A)—from the washing chamber (12), in which the entrainment device (14) is provided, to the washing chamber (12) that is arranged upstream when viewed in conveying direction (A), whereby the entrainment device comprises a metal entrainment baffle (14) which extends from a region facing the longitudinal axis (4) of the drum (2) and is laterally connected to the screw (6), and whereby the metal entrainment baffle (14) extends—viewed in a plane perpendicular to the longitudinal axis (4) of the drum (2)—in an at least partially curved manner.

2. Continuous washing machine in accordance with claim 1, wherein the Archimedean screw (6) is arranged, relative to its structural axis (27), in a manner eccentric to the axis of rotation (4) of the washing drum (2).

3. Continuous washing machine in accordance with claim 2, wherein the end of the metal entrainment baffle (14) is connected to the interior wall of the drum (2) and is also connected laterally to the screw (6), both connections being fluid-tight.

4. Continuous washing machine in accordance with claim 3, wherein the metal entrainment baffle (14) has a section that is curved about the longitudinal axis (4) of the drum (2).

5. Continuous washing machine in accordance with claim 3 or 4, wherein the radius of curvature of the metal entrainment baffle (14) increases from the inside toward the outside relative to the longitudinal axis (4).

6. Continuous washing machine in accordance with claim 3, wherein the metal entrainment baffle (14) comprises at least one rib (18).

7. Continuous washing machine in accordance with claim 6, wherein the at least one rib (18) is set on the metal entrainment baffle (14).

8. Continuous washing machine in accordance with claim 6, wherein the at least one rib (18) is canted into the metal entrainment baffle (14).

9. Continuous washing machine in accordance with claim 1, wherein respectively the metal entrainment baffle (14) is arranged in at least two adjacent washing chambers (12).

10. Continuous washing machine in accordance with claim 1, wherein the screw (6) is provided with holes.

11. Continuous washing machine in accordance with claim 1, wherein the screw (6) has cants (26) or reinforcement ribs.

12. Continuous washing machine in accordance with claim 11, wherein the cants (26) or reinforcement ribs essentially extend in radial direction.

13. Continuous washing machine in accordance with claim 1, wherein at least on rib (24) is provided on the inside of the drum (2).

14. Continuous washing machine in accordance with claim 13, wherein the at least one rib (24) extends at least in approximately the longitudinal direction (4) of the drum (2).

15. Washing process with the use of a continuous washing machine in accordance with claim 1, wherein, in washing mode, the drum (2) is rotated continuously in the first direction of rotation (C) during a washing cycle, whereby, during each rotation of the drum (2), the laundry items (22) and the treatment fluid (20) are lifted, the treatment fluid (20) perfuses the laundry items (22), a portion of the treatment fluid (2) drains over the entrainment device (14) during a further rotation of the drum (2), and whereby the laundry items (22) are then dropped into the washing chamber (12) containing the treatment fluid (20) which has flowed ahead, and that, in conveying mode for conveying the laundry items (22) from one washing chamber (12) to the adjacent washing chamber (12), the direction of rotation (B) of the drum (2) is reversed during a conveying cycle, whereby the laundry items (22) and optionally also the potentially present treatment fluid (20) are moved in conveying direction (A), on the one hand, and lifted at the same time, on the other hand, and are then dropped into the adjacent washing chamber (12), whereby, in washing mode, at least the laundry items (22) are held by the entrainment device (14) in one and the same washing chamber (12).

16. Washing process with the use of a continuous washing machine in accordance with one of the claim 1, wherein, in washing mode, the drum (2) is moved in a pivoting manner by approximately 180°+/−45°, i.e., about a pivot angle in the range of 225° to 135°, in a back-and-forth manner, and that, in conveying mode for conveying the laundry items (22) from one washing chamber (12) to the adjacent washing chamber (12), a drum (2) is rotated in a direction of rotation (B) during a conveying cycle, whereby the laundry items (22) and optionally also the potentially present treatment fluid (20) are conveyed in the conveying direction (A), on the one hand, and are lifted at the same time, on the other hand, and then dropped into the adjacent washing chamber (12).

17. Washing process in accordance with claim 16, wherein, while washing, the pivot angle is approximately 180°+/−30°.

18. Washing process in accordance with claim 16, wherein, while washing, the pivot angle is approximately 180°+/−15°.

19. Washing process in accordance with claim 16, wherein, while washing, the pivot angle is approximately 180°+/−5°.

20. Washing process in accordance with claim 15, wherein a plurality of washing cycles are successively performed, whereby respectively one conveying cycle is interposed between two successive washing cycles.

21. Washing process in accordance with claim 15, wherein the drum (2) is basically being rotated by 360° during each conveying cycle.

22. Washing process in accordance with claim 1, wherein the free treatment fluid (20) is drained over a region of the generated surface of the drum, which is provided with holes, through a dual drum, and that the laundry items (22) are then transported nearly without treatment fluid (20), into the next washing chamber or washing region.

* * * * *